US005662947A

United States Patent [19]

Kretzschmar et al.

[11] Patent Number: 5,662,947

[45] Date of Patent: Sep. 2, 1997

[54] NOZZLE PLATE HOLDING DEVICE FOR SPINNING OF CONTINUOUS FILAMENTS

[75] Inventors: Willi Kretzschmar, Grosswallstadt; Erik Orthmayer, Linsengericht, both of Germany

[73] Assignee: Rieter Automatik GmbH, Grossostheim, Germany

[21] Appl. No.: 381,910

[22] PCT Filed: Jun. 20, 1994

[86] PCT No.: PCT/CH94/00123

§ 371 Date: Apr. 5, 1995

§ 102(e) Date: Apr. 5, 1995

[87] PCT Pub. No.: WO95/00684

PCT Pub. Date: Jan. 5, 1995

[30] Foreign Application Priority Data

Jun. 21, 1993 [CH] Switzerland ..... 1853/93

[51] Int. Cl.[6] ..... D01D 4/08

[52] U.S. Cl. ..... 425/192.5; 261/176.1; 261/178 F; 425/378.2; 425/382.2; 425/464

[58] Field of Search ..... 425/191.5, 192.5, 425/378.2, 382.2, 464, 461; 264/176.1, 176 F

[56] References Cited

U.S. PATENT DOCUMENTS

| | | | |
|---|---|---|---|
| 3,028,627 | 4/1962 | McCormick | 425/191 S |
| 3,407,437 | 10/1968 | Lenk | 425/464 |
| 3,460,199 | 8/1969 | Heckrotte et al. | 425/191 S |
| 3,480,995 | 12/1969 | Lenk | 425/464 |
| 3,500,499 | 3/1970 | Goosens | 425/192 S |
| 3,655,314 | 4/1972 | Lenk et al. | 425/378.2 |
| 3,891,379 | 6/1975 | Lenk | 425/192 S |
| 4,099,898 | 7/1978 | Beck | 425/378.2 |
| 4,437,827 | 3/1984 | Moderlak et al. | 425/378.2 |
| 4,493,628 | 1/1985 | Lenk | 425/192 S |
| 4,494,921 | 1/1985 | Sowell | 425/198 |
| 4,645,444 | 2/1987 | Lenk et al. | 425/192 S |
| 4,696,633 | 9/1987 | Lenk et al. | 425/192 S |
| 4,698,008 | 10/1987 | Lenk et al. | 425/192 S |
| 4,801,257 | 1/1989 | Lenk | 425/378.2 |
| 5,352,106 | 10/1994 | Lenk et al. | 425/192 S |

FOREIGN PATENT DOCUMENTS

| | | | |
|---|---|---|---|
| 0122464 | 10/1984 | European Pat. Off. . | |
| 0300120 | 1/1989 | European Pat. Off. . | |
| 1529819 | 3/1970 | Germany . | |
| 1660697 | 10/1971 | Germany . | |
| 2234615 | 2/1974 | Germany . | |
| 8407945 | 5/1984 | Germany . | |
| 8416163 | 9/1985 | Germany . | |
| 0163248 | 12/1985 | Germany . | |
| 3818017 | 12/1988 | Germany . | |
| 9313586 | 12/1993 | Germany . | |
| 780743 | 8/1957 | United Kingdom | 425/191 S |

*Primary Examiner*—Jay H. Woo
*Assistant Examiner*—Duane S. Smith
*Attorney, Agent, or Firm*—Burns, Doane, Swecker & Mathis, LLP.

[57] ABSTRACT

A nozzle package is connected at its lower end to a heating box by means of elements which permit a good heat transfer to the nozzle plate included in the nozzle package.

8 Claims, 4 Drawing Sheets

Fig. 1
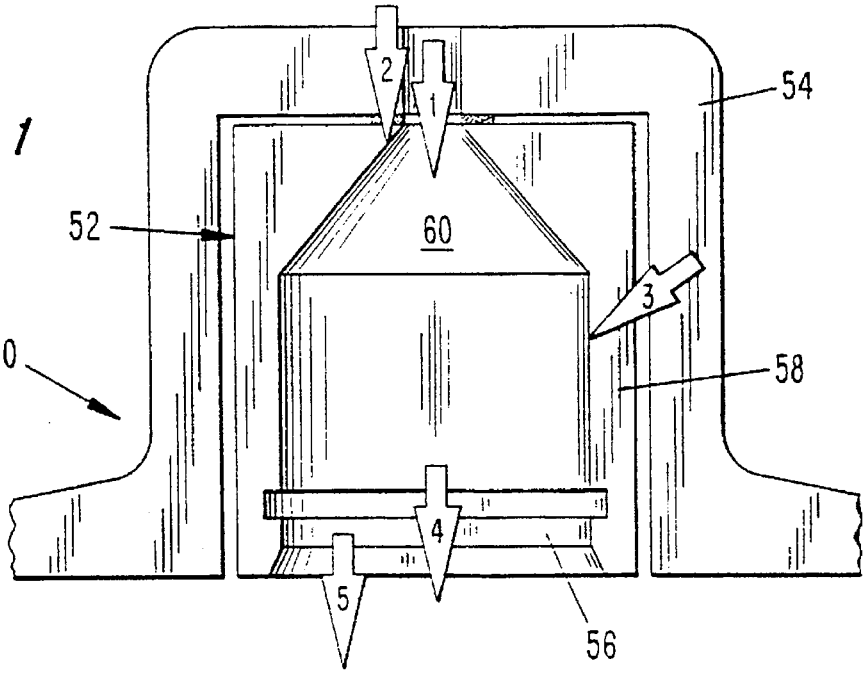
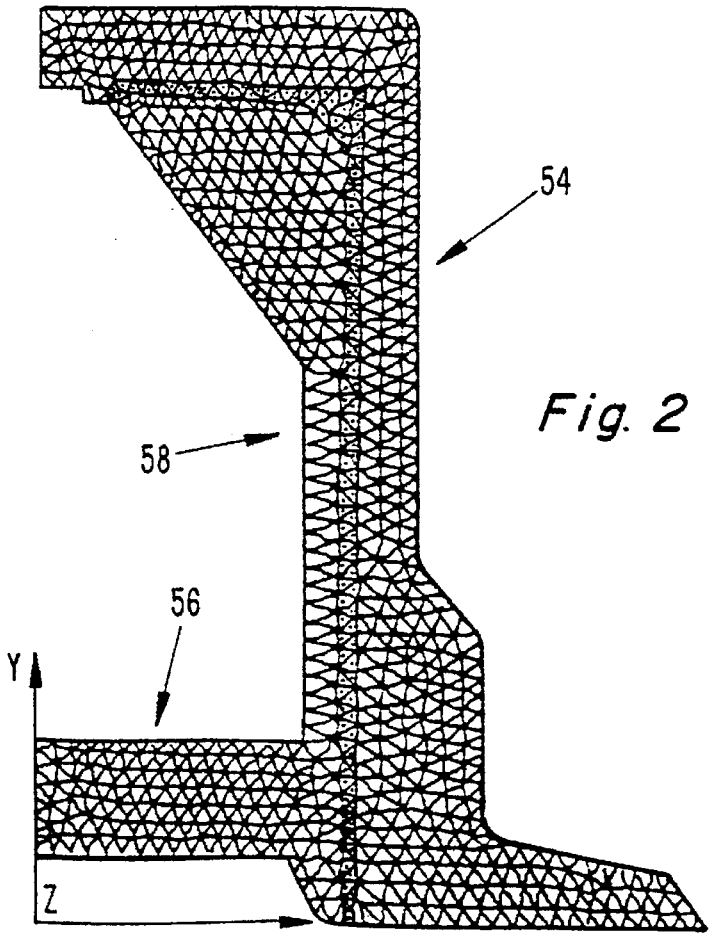
Fig. 2

NOZZLE PLATE HOLDING DEVICE FOR SPINNING OF CONTINUOUS FILAMENTS

FIELD OF THE INVENTION

The invention relates to a nozzle plate holding device and to a spinning beam for melt spinning of continuous filaments, especially of thermoplastic material (melt). The spinning beam comprises, for example, a heating box into which extend melt lines, melt pumps and nozzle pots (also called "nozzle packages") ending in nozzle plates. The nozzle pots may form vertically turned-in portions of the heating box and may be attached in bell-shaped receptacles having a vertical, central melt conduit which runs into a melt inlet of the nozzle pots. The nozzle plate holding device forms a part of a nozzle pot.

DISCUSSION OF PRIOR ART

During melt spinning the temperature management of the melt from the extruder to the discharge from the spinning nozzle is of utmost importance. Particular attention has to be paid that the melt has the same thermal history for all filaments as regards to temperature and dwell time. Minor deviations of, e.g. only 2° C., may already lead to visible dyeing differences or increased capillary breakage rates. In order to ensure a constant temperature the product lines and the spinning beams are presently usually condensation-heated. Condensation heating allows very precise temperature management because with this principle primarily those spots of the room impinged with saturated steam can be heated intensively which have a lower temperature than the condensation temperature of the saturated steam. This results in a very even temperature distribution at the condensation surfaces. Hence, this heating principle permits accurate temperature control of the entire melt distribution system to the degree while employing relatively simple means.

In the area of the melt discharge this is somewhat more problematical, however. Prior to the discharge of the filaments from the spinning nozzles another filtration and homogenization of the melt takes place in the nozzle packages. These have to be removed from the spinning beams for cleaning purposes or when resetting the product for a different number of filaments. Assembly and disassembly of the nozzle packages should be as simple as possible in order to restrict the work therefor to a minimum. For this reason the saturated steam cannot circulate directly around the nozzle packages. Therefore, the heat supply to the nozzle packages takes place only via heat conduction at the contact surfaces between the nozzle package and the spinning beam as well as by the supplied melt. On the other hand, however, the heat loss to the environment at the nozzle plates is extremely high, because they cannot be insulated. This means that primarily in the area important for filament formation an exact temperature management is particularly difficult. Therefore, a closer study of this area is absolutely necessary, especially because there has been and still is a trend to finer filaments for which the melt flow through the nozzle package, and consequently also an important heat supply, decreases.

The requirements concerning transmission of heat, or evenness of temperature, have been known for a long time and have been clearly formulated also in patent literature, see e.g. U.S. Pat. No. 4,437,827, in which heaters provided especially therefor were proposed to solve this problem. The efforts connected therewith are considerable. If however the otherwise lacking heat has to be supplied along via the melt it may be necessary to increase the melt temperature which would result in a loss in quality.

At the same time a nozzle package, however, must meet many other requirements. It should e.g.:

be easy to replace, require no extraordinary process tolerances during manufacture, create a sufficient sealing effect against melt leakage.

In case of a round nozzle package it should additionally be adjustable in a predefined angle position around a vertical axis in order to ensure proper arrangement of each fibril in the space below the nozzle. The previous attempts to meet these demands have led to a variety of proposals and practical embodiments of which only a few examples shall be listed below.

In most cases the connection with a carrier in the spinning beam is made on the upper (inner) end of the nozzle package (see e.g. DE-C-1246221, DE-A-1660697, and U.S. Pat. No. 4,696,633). This will be the case even if the package has to be introduced into the receptacle provided therefor from the top or from the side (e.g. according to U.S. Pat. No. 3,655,314, or U.S. Pat. No. 3,891,379).

It is known to attach the nozzle package via a flange to the lower end with screws—see, e.g., U.S. Pat. No. 4,494,921. However, the attachment means is used in said example to create the required sealing forces (by compressing a packing ring at the upper end of the package). Therefore, an air gap remains between the flange and the carrier (the heating box).

It has even been proposed to provide "support strips"0 in a rectangular package such "that via metallic heat contact between the side walls of the heating box and the side walls of the spinning head, good heat transmission takes place from the heating box to the spinning head such that practically no temperature differences exist between the two" (EP-B-271801). This object however cannot be taken seriously as will be shown in the subsequent explanations of the present invention. The application of such ideas in connection with a round nozzle package has not been proposed as of yet.

A "good heat transmission" based on the surface pressure of the nozzle plate holding device and a carrier is to be achieved also according to DE-C-1529819. It requires however a special formation of the carrier which impedes an effective heating of this part.

A known spinning beam is e.g. described in DE-Gbm 84 07 945. In this spinning beam the receptacle for the nozzle pot (the nozzle package) is welded into the heating box and hence practically a part of the heating box. The arrangement of the nozzle pot in the receptacle is provided such that a layering, consisting of nozzle plate, filter housing and nozzle pot bottom, is screwed to the bottom of the receptacle by means of bolts which penetrate the layering and which are screwed into an internal screw thread in the bottom of the receptacle. For example, in order to remove the nozzle pot together with its components from the receptacle for necessary cleaning, the screws must be loosened and then the nozzle pot can be pulled vertically downwards and out of the receptacle. Given that the nozzle pots require frequent cleaning, at times daily, which depends on the material to be processed, there is a considerable wear of the bolts in the area of the internal screw thread in the bottom of the receptacle. Here the bolts must be tightened strongly on account of the pressures of about 120–350 bar commonly existing in the nozzle pot which must be effected with a dynamometric key in order to avoid damage to the bolts and the thread. Normally, at least four bolts are required for attaching a nozzle pot so that there results a considerable amount of required work for each cleaning of the nozzle pot.

A different arrangement of a nozzle pot in a receptacle in connection with a spinning beam is known from the European Patent Publication 163 248 (see especially FIGS. 3 and 6). In this embodiment the nozzle pot has a hollow cylinder which carries the nozzle plate by means of an inwardly reaching step on which nozzle plate the filter housing is supported over a circulatory joint. Above the filter housing an axially movable piston having a central passage hole is mounted in the hollow cylinder which is supported via a membrane in the form of an up side down dish over the dish edge with the nozzle pot empty. In case of pressurized filling of the nozzle pot a gap between the filter housing and the membrane is filled with melt which presses the membrane away across a cross-section practically corresponding to the piston cylinder and hence presses the piston away from the filter housing. In this movement the piston stroke is limited by a packing ring surrounding the central opening which packing ring rests against a ring nut which is attached via bolts to a pump block that is rigidly arranged in the heating box. The hollow cylinder is screwed with an inner thread onto the ring nut, which is provided with an outer thread, by way of which the nozzle pot which is supported by the step of the hollow cylinder is attached to the heating box. To remove the nozzle pot the hollow cylinder is to be screwed off from the ring nut. The thread and the membrane of this arrangement are subject to a very considerable load, because the sealing membrane, which extends over the entire cross-section of the inner space of the hollow cylinder, and the thread are burdened by a force determined by the pressure and said cross-section which may amount up to 15 t due to the relatively large cross-section of the inner space of the hollow cylinder. Hence, due to the arrangement of the thread in the area of the bottom of the receptacle there results for the filter pot a necessary free ring space between the outer surface of the hollow cylinder and the opposite wall of the heating box, because the screwing-in and screwing-out of the hollow cylinder requires a certain play. This results in a heat transfer from the corresponding wall of the heating box to the hollow cylinder which is interrupted by the ring space primarily in its area in which it carries with its step the nozzle plate so that the required continuous sufficient heating of the nozzle plate is rendered more difficult.

SUMMARY OF THE INVENTION

Therefore, it is the object of the invention to facilitate, especially to speed up, the assembly and disassembly of the nozzle pots with a reduced load on the sealing.

This is achieved according to the invention on the one hand in that the receptacles are provided in the area of the nozzle plates with inwardly reaching shoulders which are confronted with corresponding rests on the nozzle pots in such manner that the nozzle pots can be screwed into the receptacles, the shoulders and the rests locking the nozzle pots axially into the receptacle when in contact, on the other that between the melt inflow of the nozzle pots and the bottom of the receptacles gaskets are placed so that the melt flowing into the nozzle pots sealingly presses the gaskets against the bottom of the receptacles and an inner edge of the nozzle pots while leaving a passage hole for the melt.

By way of this formation there results a continuous heat transfer from the inwardly turned receptacle in the heating box to the nozzle pot in the area of the nozzle plates due to the there inwardly reaching shoulders, i.e., via the contact between the shoulders and the rests arranged on the nozzle pots so that the nozzle pot and hence the nozzle plate arranged directly in it are supplied in a sufficient and favorable manner with the necessary heat. Due to the positioning of the gaskets against the inner wall of the nozzle pots there remains only a relatively limited movement range for the gaskets which corresponds to the surface in the direct area of the passage hole so that the corresponding area of the packing ring does not have to sustain considerable large forces.

Advantageously the gaskets are designed bell-shaped with a central passage hole, in assembled state they rest with their bottoms surrounding the passage hole on the bottom of the receptacles, and the outer edges of the gaskets rest on a ring shoulder in the nozzle pot. Due to this formation of the gaskets, when filling the nozzle pot, under the pressure of the melt they press on the one hand against the bottom of the receptacle, this way the sealing effect between the nozzle pot in the area of the central passage hole of the gasket and the bottom of the receptacle automatically adapt to the corresponding prevailing pressure.

The nozzle pots are advantageously designed so that in a hollow cylinder of the nozzle pot the nozzle plate, a filter housing and above it a ring nut forming the nozzle pot floor with central opening are layered, the hollow cylinder carrying the nozzle plate with a step and the ring nut being screwed into an internal screw thread of the hollow cylinder while pressing together the layered components, the nut shoulder pressing the gasket arranged on the filter housing against a conical inner surface of the ring nut in such manner that the gasket slightly protrudes from the central opening of the ring nut with its area surrounding the passage hole.

On account of this formation the gasket receives a centering through the conical inner surface of the ring nut so that after assembly of the nozzle pot it can be attached in the receptacle with proper position of the packing ring by way of the above mentioned bayonet lock. The gasket then immediately presses into its right position against the bottom of the receptacle, the nozzle pot being sealed and prepared to being filled with the material to be processed.

For the formation of a sealing between the filter housing and the nozzle plate the filter housing is advantageously designed so that in assembled condition of the nozzle pot the filter housing sits with a cylindrical projection on the nozzle plate and the projection surrounds a ring-shaped recess in the filter housing into which the packing ring is placed.

After completed assembly of the nozzle pot and after putting it under pressure, the cylindrical projection on the filter housing rests against the nozzle plate, this way the ring-shaped recess within the projection formed by the projection is limited to the height of this projection. The packing ring placed into the recess cannot be excessively compressed. The sealing effect of the packing ring is determined here automatically by the pressure prevailing in the nozzle pot, because this pressure presses the packing ring outwardly against the projection and automatically closes a possible gap between the projection and the opposite surface of the nozzle plate. The projection furthermore offers the advantage that with it the entire height of the nozzle pot is also determined, which therefore has a defined size when assembled.

Advantageously the shoulders arranged on the receptacles and the rests provided on the nozzle pots are designed according to a bayonet lock. This results in a connection between the nozzle pot and the receptacle that is extremely easy to open and close, i.e., simply by a turn of max. about 90°. Correspondingly, at the bayonet lock practically no wear appears even if the nozzle pot is removed frequently.

Advantageously, the formation of the receptacles with the inwardly reaching shoulders which are faced by corresponding rests on the nozzle pot, and the arrangement of the gaskets that are supported on the bottoms of the receptacles can be used in combination, both measures supplementing each other for a quicker and safer assembly and disassembly.

BRIEF DESCRIPTION OF THE DRAWINGS

The invention is described in detail based on the Figures of the drawings, wherein:

FIG. 1 shows schematically the heat flows at a nozzle package,

FIG. 2 shows a model of the package that has been formed according to the finite element theory.

Heat Balance of the Nozzle Package

Figure 3:
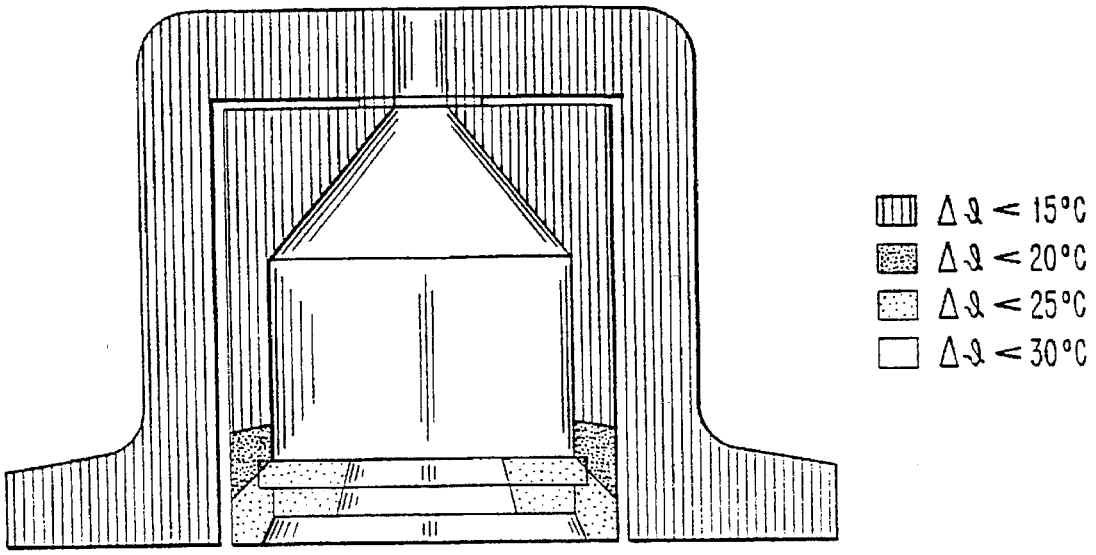
FIG. 3 shows schematically the temperature distribution in a nozzle package of conventional construction.

FIG. A chows the heat flows at a nozzle package.

A carrier is shown with the reference number 50 and the nozzle package with 52. The carrier 50 is part of a heating box which today is normally heated with diphyl steam (e.g. according to DE-Gbm 09313586.6 from 7 Sep. 1993). The package is received in a receptacle (the "nozzle cavity") 54 in the carrier. The package 52 comprises especially a nozzle plate 56 and a holding device 58. The holding device 58 has a hollow 60 which contains further elements of the package as is described below based on FIG. 5. These elements are superfluous for the schematic representation of the heat balance according to FIG. 1, however, and are not described in detail in connection with the Figure. The essential heat flows in FIG. 1 are shown as follows:

- arrow 1: heat flow into the nozzle package through the entering melt
- arrow 2: heat flow into the nozzle package through contact with the cavity
- arrow 3: heat flow into the nozzle package through the air gap
- arrow 4: heat flow from the nozzle package through the exiting melt
- arrow 5: heat flow from the nozzle package through the heat radiation of the nozzle plate.

Due to the process the melt makes up for the largest part of heat supply as well as carrying-off heat. Ideally, both heat flows are equal in amounts. This would mean that the melt maintains a constant temperature until it discharges from the nozzle. In order to guarantee this, the other heat flows would have to be in balance. Special difficulties are here created by the heat losses of the nozzle plate. Given that it cannot be insulated, a large part of the heat amount is given off to the environment in form of radiation and convection. This heat amount must now be guided as far as possible from the spinning beam via the nozzle package to the nozzle plate in order to reduce the cooling-off of the melt to a minimum.

With nozzle packages of conventional construction this heat supply takes place exclusively from the top. The reason for this is the sealing of the nozzle packages. In order to guarantee that no melt exits laterally next to the nozzle package they are pressed tightly against a gasket on the top. By way of this compression a good thermal bridge is created which however is located on the side opposite to the nozzle plate. Also in embodiments which are attached with a flange to the bottom of the spinning beam a possible additional heat flow through the lower flange is to be neglected, because here an air gap is located between the flange and the spinning beam. The thermal conduction value of air however is lower than that of the nozzle package and the spinning beam by the factor 1 000. Even with an air gap of only 1/10 mm the possible heat flow is negligibly low, because this supply is over-compensated by the enlargement of the radiating surface in connection thereto.

FEM-Calculations

It is possible to calculate the heat distribution within the nozzle package and the nozzle cavity with the help of the finite element method (FEM). Given that in studies of the heat flow it is of primary interest how the heating through the actual device components takes place, calculations without melt have been made which led to the model according to FIG. 2. The temperature difference to the diphyl temperature hereby represents a measure for the heat amount that is extracted from the melt. In order to compensate a temperature difference of 10° C. without polymer of the nozzle plate in comparison to the melt, the melt is cooled in production by an average of about 0.5° C. depending on the polymer, the nozzle diameter and the throughput.

For the calculations it is supposed that the heating box as well as the nozzle package have a homogeneous heat conduction capability. Given that the surface pressure of the parts in contact of cavity and nozzle package is relatively high, calculation at these transfers is done with the same heat conduction capability. The spaces between nozzle package and cavity that are filled with air are very small so that a movement of the air can be excluded. It can be assumed that the heat transport through the air gap takes place exclusively via heat conduction. The finite element model of nozzle cavity and nozzle package shown in FIG. 2 is created. At the borders of the model various heat transfer coefficients as well as ambient temperatures can be employed. This way the heat transfers by way of steam condensation, fluid heat carrier, radiation to the exterior and heat conduction in the insulation is taken into consideration. With the given boundary conditions the temperature distribution in stationary state can be calculated and shown with the FEM-program.

FIG. 3 shows the temperature distribution in the nozzle package with a nozzle diameter of 90 mm calculated this way. A temperature difference ($\Delta 9$) of about 30° C. has been calculated between the diphyl steam room and nozzle plate. Depending on constructional embodiment (air gap, wall-thickness, etc.) this value can also vary by several degrees. Measurements at the pilot plant confirm the result of these calculations. This means that to equalize this temperature difference the melt is extracted such an amount of heat that it cools off by about 1.5° C. by the time it exits from the nozzle. This temperature difference however is not to be viewed as constant over all nozzles. Rather, it may vary strongly if the conditions of heat conduction change. Contamination in the nozzle cavity, e.g., can form thermal bridges and hence considerably influence an even heat supply to the nozzle plate. Therefore, this temperature difference represents a measure for the accuracy of the temperature management of the melt at the nozzle discharge, this being of great importance especially with very fine filaments. Measurements at nozzle plates in production plants confirm that with nozzle packages of conventional construction the spreading of the temperatures is within a range of 2° C.

In order to estimate also the influences of constructional features several dimensions have been varied and the temperature distributions have been determined. An enlargement of the heat transfer surface on top of the nozzle package, e.g., by using a larger sealing, showed practically no influence on the temperature of the nozzle plate. Even with a contact of the entire upper surface of the nozzle package with the cavity merely yields a temperature increase of max. 1° to 2° C. On account of the appearing gradient this influence is negligibly low. The reason for this are on the one hand the relatively long heat conduction paths from the upper side of the nozzle package to the nozzle plate. On the other hand the heat flow is restricted by the narrowest cross-section of the conductor of heat which is essentially predefined by the wall-thickness of the nozzle package.

Improvement of the Heat Flow Into the Nozzle Plate

Based on the analyses of the heat flow a new nozzle package has been developed in which the heat conduction paths from the diphyl steam room to the nozzle plate have been greatly shortened. The object of this measure is an improved heat compensation at the nozzle plate. Therefore, in the preferred embodiment of this solution a bayonet lock has been attached at the height of the nozzle plate. This way additional heat conduction paths have been created which enable a heat flow as close as possible to the place of heat loss.

Figure 4:
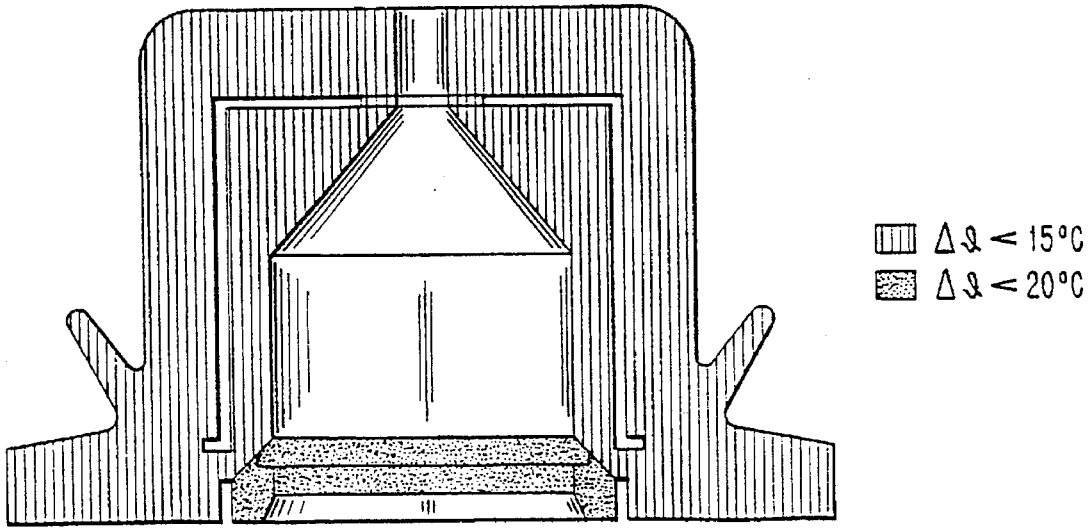
FIG. 4 shows schematically the temperature distribution in a nozzle package which is designed according to this invention.

In order to design this heat supply as large as possible, changes are required at the spinning beam as well. Therefore, it is important that the condensation surface is as large as possible, especially at the lower side of the nozzle cavity. It must be assured that a sufficient heat amount is available for the temperature compensation of the nozzle plate. If this is not the case even the opposite effect can be achieved in that the heat is not supplied to the nozzle plate but carried off from it. In the construction of the spinning beam, e.g., two measures can be implemented which have been described in the German registered utility patent no. 9313586.6. On the one hand the interior of the heating box is so designed such that the diphyl flows off immediately and hence no liquid swamp forms in the cavity area. Furthermore, for the enlargement of the condensation surface ribs are attached to the nozzle cavity. This way a sufficient heat supply to the nozzle package is guaranteed. The result of this construction can be seen in FIG. 4. The temperature gradient of diphyl steam room to nozzle plate could reduced according to the finite element calculations by about 10° C. to 20° C. This is an improvement of the temperature management of about 30% as compared to the conventional construction.

DESCRIPTION OF PREFERRED EMBODIMENTS

Figure 5:
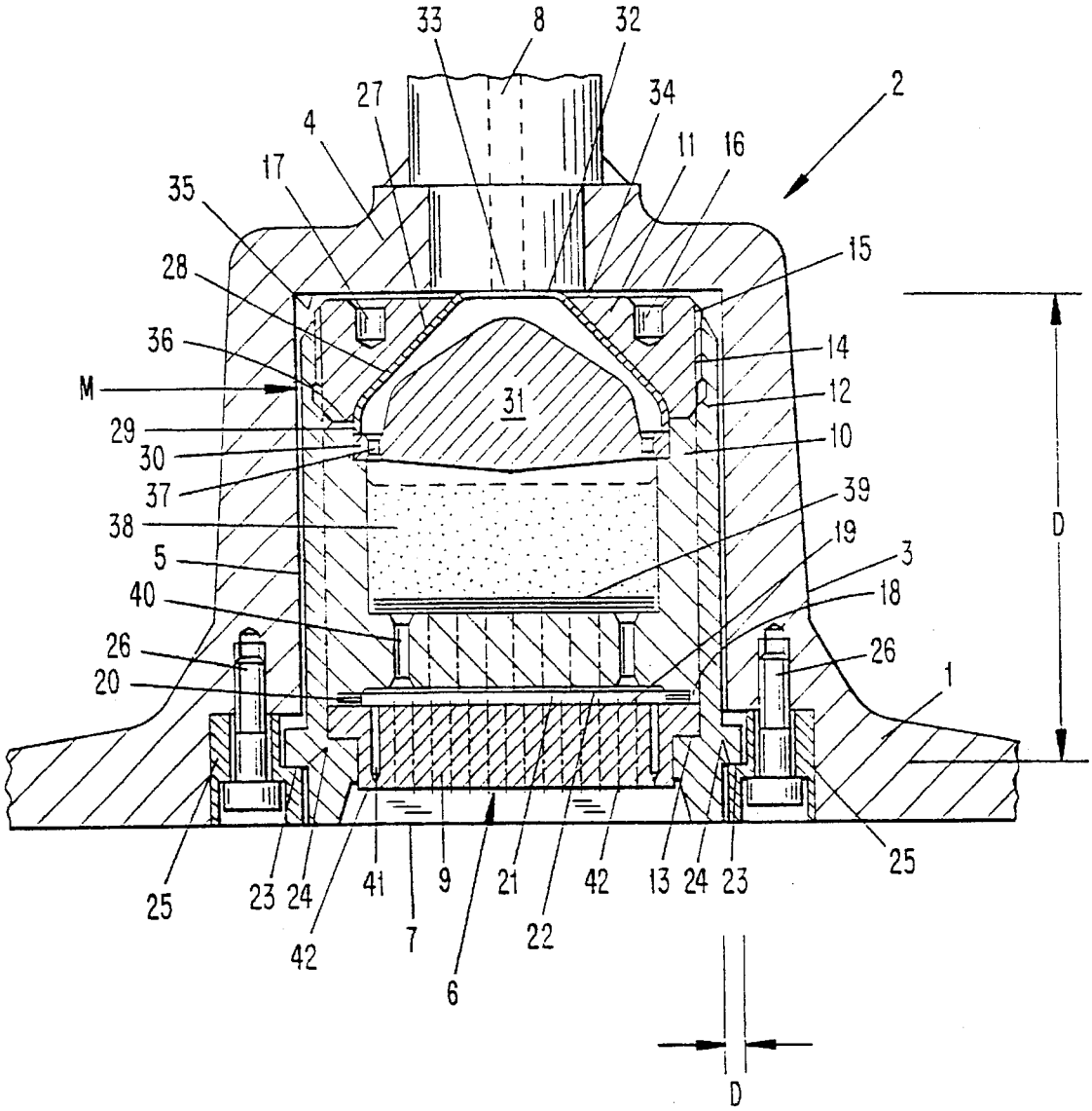
FIG. 5 shows an embodiment of the invention.

FIG. 5 shows a section of a spinning beam with a nozzle package (especially of a nozzle plate holding device) according to this invention. The spinning beam comprises a heating box 1, into which extend melt lines and melt pumps (not shown), as shown, e.g., in the Figures of the above-mentioned DE-Gmb 84 07 945. In the heating box 1 the receptacle 2 is inserted, e.g., by way of welding, which consists of the wall 3 which is concluded towards the interior by the bottom 4. The receptacle 2 encloses the cylindrical inner space 5 into which the nozzle pot 6 is inserted. For this purpose the inner space 5 passes over to the outer room via the cylindrical opening 7. The bottom 4 is penetrated by the melt conduit 8 which is connected to a melt pump (not shown).

The nozzle pot 6 is a rotation body, and it is shown in the Figure in section like the receptacle 2. The nozzle pot 6 consists of layered components, i. e., of the nozzle plate 9, the filter housing 10 and the thread nut 11. These three components are placed into the hollow cylinder 12 which carries with its step 13 the nozzle plate 9. On the side of the thread nut 11 the hollow cylinder 12 is provided with the inner thread 14 into which the thread nut 11 is screwed in with its outer thread 15. To screw the thread nut 11 into the hollow cylinder 12, the thread nut 11 is arranged with the pocket holes 16 and 17 into which a matching sickle spanner fits. The screwing-in of the thread nut 11 into the hollow cylinder 12 is limited by the cylindrical projection 18 at the side of the filter housing 10 facing the nozzle plate 9. Once during screwing-in of the thread nut 11 the projection 18 rests on the surface 19 of the nozzle plate 9, the entire length of the nozzle pot 6 is determined. Within the cylindrical projection 18 a ring-shaped recess is present which is filled by the packing ring 20. The packing ring 20 is pressed towards the outside against the cylindrical projection 18 by the pressure of a material to be processed which for this fills out the intermediate space 21 between the surface 19 and the bottom surface 22 of the filter housing 10, and this way with the effect of this pressure a sealing adapted to the pressure results automatically between the filter housing 10 and the nozzle plate 9.

The hollow cylinder 12, which as component of the nozzle pot 6 carries with its step 13 the nozzle plate, is itself retained in the receptacle 2, i.e., by means of the shoulder 23 which is faced in the shown built-in condition by the supports 24 on the hollow cylinder 12. The shoulders 23 form components of the insert pieces 25 which are inserted into the wall 3 of the receptacle 2 and which are tightly screwed together with the wall 3, i.e., by means of bolts 26. The shoulders 23 and the supports 24 together form a bayonet lock which axially locks the nozzle pot 6. Simultaneously, the bayonet lock forms a direct thermal bridge via the shoulders 23 and the supports 24 via which the nozzle plate 9 is directly heated. By turning the hollow cylinder 12 and hence by turning the nozzle pot 6 by about 90°, the connection between the receptacle 2 and the nozzle pot 6 is released. The nozzle pot 6 can then be removed from the receptacle 2 through the cylindrical opening 7 and disassembled into its parts, e.g., for cleaning purposes of the filter housing 10 and of the nozzle plate 9.

When inserting the nozzle pot 6 into the receptacle 2 the gasket 27, which is placed essentially in a conical embodiment in the thread nut 11, becomes effective and said thread nut has a conical inner surface 28 for the reception of the gasket 27. The gasket 27 rests with its outer edge 29 on the ring-shoulder 30, which is part of the melt distributor 31 resting on the filter housing 10. This melt distributor 31 is here a component of the nozzle pot 6, it serves to distribute the melt supplied through the melt conduit 8 within the interior of the nozzle pot favorably, which will be described in detail below.

In assembled condition of the nozzle pot 6 the gasket 27 is supported, as mentioned, the ring shoulder 30, this way it extends vertically towards the top into the bottom 32, which surrounds the passage hole 33 that is in alignment with the melt conduit 8, while being in contact with the conical inner surface 28 of the thread nut 11.

As the figure shows the bottom 32 of the gasket 27 slightly protrudes as opposed to the surface 34 of the thread ring 11 so that when closing the bayonet lock 24/25 the bottom 32 rests tightly on the bottom surface 35 of the bottom 4 of the receptacle 2. This way the sealing is created between the bottom 4 of the receptacle 2, which is penetrated by the melt conduit 8, to the nozzle pot 6, i.e., while taking advantage of the pressure prevailing in the interior of the nozzle pot 6 which presses the gasket 27 against the bottom surface 35 and the conical inner surface 28 of the thread nut 11 depending on how high the pressure is. Furthermore, the gasket 27 is pressed radially outwardly against the point of impact 36 between the thread nut 11 and the filter housing 10 so that here too a safe sealing is created.

During operation the melt flow takes place as follows: the melt flows from the melt conduit 8 through the passage hole 33 to the melt distributor 31 which is overflowed by the melt and which reaches the conduits 37 of which conduits only two are shown. In the shown embodiment about 24 such conduits are present. The melt then flows through the filter 38 which towards the bottom is concluded by the grid 39. Furthermore, in the filter housing 10 the conduits 40 are arranged (about 50 such conduits are present) from where the melt flows into the intermediate space 21. Now the melt flows through the nozzle plate 9, i.e., through the bores 41 which end in capillaries in the lower limitation surface 42 of the nozzle plate 9. Here the filaments exit singly which are then comprised to form single threads.

Figure 6:
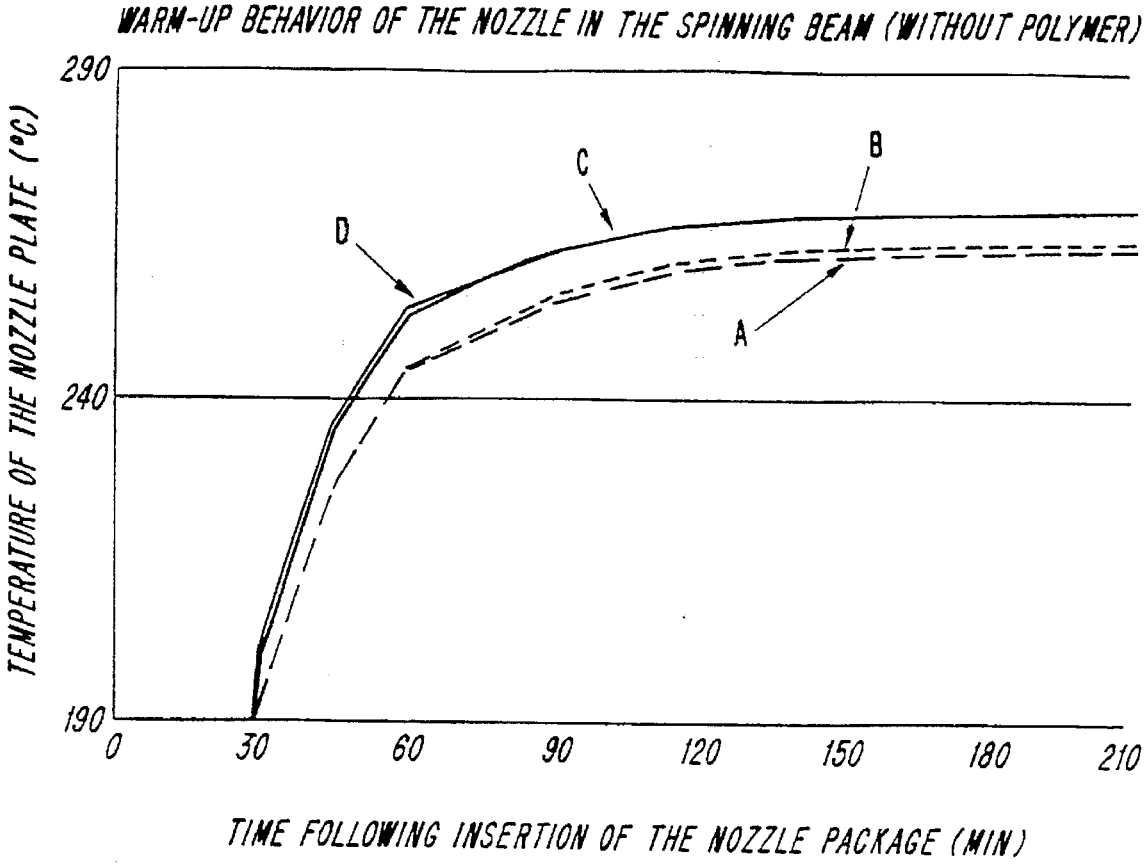
FIG. 6 shows in a diagram the experimental result concerning the heat-up behaviour of the spinning nozzles in the spinning beam without polymer(melt)

For the verification of the theoretical studies temperature measurements at the spinning beam have also been made. A spinning beam has been modified in such manner that a nozzle package of conventional construction as well as the new nozzle package according to FIG. 5 ("Quick Fit") could be employed side by side. By way of this experimental arrangement influences which go beyond the differences of construction could be excluded to a large extent. For the experiment the spinning beam was heated to a diphyl temperature of 290° C. Subsequently, the two nozzle packages were employed cold (about 20° C.) and the temperature was measured at the nozzle border and nozzle center. FIG. 6 shows the result of this experiment.

In FIG. 6 the dashed curve A represents the heat-up behaviour (temperature course over a time after the assembly into the spinning beam - without polymer) of a conventional nozzle package in the nozzle center, while the dashed curve B shows the corresponding behaviour in the border part of a conventional package. Curve C shows the heat-up behaviour in the nozzle center of a package according to this invention (e.g. according to FIG. 5), while curve D (which coincides to a large extent with curve C) shows the heat-up behaviour of the border part of the new package.

The new nozzle package with the improved heat flow clearly reaches the final temperature earlier than the nozzle package of conventional construction. Furthermore, the final temperature of the new nozzle package is about 10° C. higher, which corresponds to the calculations. The temperature difference between the nozzle center and the nozzle border already is negligibly low with the nozzle package of conventional construction, however with the new nozzle package it could be improved by the last nuance. Hence, the experiment confirms the calculated results, according to which the cooling-off of the melt in the new nozzle package is about 0.5° C. lower than with the nozzle package of conventional construction. This value seems to be quite small but is of major importance for the quality of the produced yarn especially in the manufacture of microfilaments.

Figure 7A:
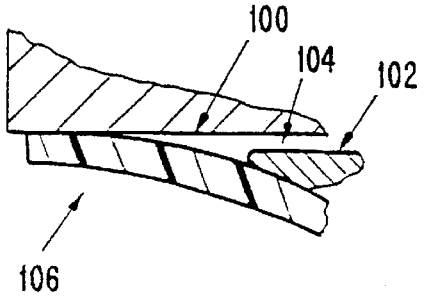
FIGS. 7A and 7B show a schematic representation of the conditions in the area of the melt supply.

FIG. 7A shows "optimum" conditions in the area of the melt supply in the "nozzle cavity", i.e. in the receptacle in the heating box which accommodates the nozzle package. The receptacle itself has an axial surface 100 which is directed in the spinning direction. This surface faces a front face 102 of the nozzle package after the package is in its operating condition, a gap 104 being present inbetween. The distance between the front face 102 and the contact surfaces of the receptacle can be determined during the manufacture or assembly (i.e. during construction) of the package without having to consider the manufacturing tolerances of the heating boxes.

A flexible insulation lip 106 extends out from the upper end of the package in order to touch the surface 100. The hardness, flexural strength, and dimensions of the flexible lip have been chosen such that the surface-to-surface contact according to FIG. 7A is created. Ideally, the lip adjusts to unevenness of the surface 102.

The risk of a leakage between the lip and the surface 102 is small upon first entrance of the melt through the admission conduit, because the melt pressure is low, until the chamber in the package below the lip has been filled. Until this has occurred the lip is pressed additionally against the surface 102 by the melt, this counteracts the risk of a leakage.

Figure 7B:
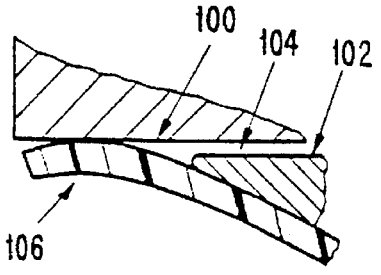

The contact conditions prior to the entrance of the melt are important as is intended to be shown by the faulty design according to FIG. 7B. Here the elasticity of the lip has been chosen too great. Therefore, the lip edge bends towards the bottom again which leaves open a wedge gap between the edge and the surface 102. This yields a surface of attack for the entering melt which may lead to a "peeling off" of the lip from the surface 102 and lead to a leakage. Of course, a leakage can also be formed in that the elasticity, which presses the lip against the surface 102, is chosen too low so that the entering melt can penetrate into the remaining gap between the lip and the surface 102.

The lip is provided on a sealing body which is "embedded" in the package so that the body is supported against the melt pressure by the package and only the lip must deform under the melt pressure. Preferably, the lip forms one piece with the body. Advantageously, the body can be formed, or arranged, in such manner that it can accept additional sealing functions in the package itself.

The sealing element (the lip) can be plastically deformable under operating pressure, the element then having to be replaced prior to a renewed insertion after removing the package from the cavity. The material of the element however can be chosen so that the element can be elastically deformable and hence reusable also under the operating pressure, e.g., if a chrome steel is used. When reinserting the package (prior to the entering of the melt) the sealing is preferably elastically deformable.

The sealing element (the sealing lip and the sealing body) are exposed to the melt during operation. Therefore, a sealing material must be chosen that will not react with the melt. A metal is preferred, aluminum and steel being suited in most cases. A sealing according to FIG. 5 (with a lip and a body part consisting of one piece), in which the conical body part is in contact with a conical support surface in the package, can be shaped, e.g. by a deep-draw method or by metal stamping. A sheet thickness of up to about 3 mm (e.g. for steel about 1 mm and for aluminum 1.5 to 2 mm) is employable.

Preferably, the package is provided with a limit stop which determines in the operating position of the package its angle position around a vertical axis. This way the arrangement of the bore in the nozzle plate can be predefined towards the cooling duct. Where the connection to the carrier is effected via a bayonet lock, at least one element of the lock can exert the function of the limit stop.

A multiple bayonet lock could be used, this may require measures in order to distribute the surface pressure over the rests of the lock. Normally, this will require tighter manufacturing tolerances. Given that the radial dimension of these rests strongly influences the division (the mutual distance) of the packages in the spinning beam, this dimension should be maintained as small as possible because a minimal division is generally desirable. The radial distance between the jacket surface of the package and the outer end of each rest is preferably not greater than 10 mm. In case of a multiple lock this dimension can be maintained smaller than 5 mm. Preferably no more than three rests are present per thread.

The invention in its first aspect (connection at the lower end of the package) yields as short as possible flow paths for the heat between the heating box and the nozzle plate. This aspect of the invention is not restricted to the employment in combination with a sealing lip, even though, preferably it is employed in combination with a sealing which develops its full sealing effect through the melt pressure. Such sealings are also known, e.g., from U.S. Pat. No. 4,645,444.

The new sealing type itself is of advantage, independent from the connection between the nozzle package and the heating box - it can replace, e.g., the piston sealing according to DE-C-12 46 221 or DE-C-15 29 819 or U.S. Pat. No. 4,696,633.

In FIG. 5 the cylindrical jacket surface of the nozzle package is shown with M. This surface must have a somewhat smaller diameter than the interior surface of the nozzle cavity in order to enable the problem-free insertion of the package into the cavity. The distance A between the bottom side of the rests and the more distant front face of the package is chosen somewhat smaller than the depth of the cavity in order to ensure the insertion of the package without contact with the end surfaces of the cavity. The radial dimension of the rest is shown with D.

The concept of a connection at the lower end of the package naturally requires the corresponding formation of the lower end of the nozzle cavity. This can take place with the formation of the heating box itself, but preferably a carrier frame for the package is designed separately and is attached to the heating box, e.g., by means of screws, as shown in FIG. 5. Preferably, the frame is replaceable, i.e., the attachment means can be loosened Without destroying parts.

We claim:

1. A holder for a nozzle plate for continuous filament spinning apparatus, said holder comprising a hollow, generally cylindrical, body provided with an upwardly facing, radially extending, step on its inner surface for supporting the periphery of the nozzle plate; means for cooperating with said body for clamping the nozzle plate against said step; and diametrically opposed supports projecting radially outwardly from the outer cylindrical surface of said body for attachment by a bayonette connection to a spinning beam.

2. A holder as claimed in claim 1, wherein said holder has a melt inlet and is provided with a sealing member which surrounds the inlet.

3. A holder as claimed in claim 2, wherein the sealing member has a flexible lip which is elastically deformable under the melt pressure.

4. A holder as claimed in claim 3, wherein said lip is provided on a part that is against the melt pressure.

5. Apparatus for spinning continuous filaments comprising a spinning beam; a nozzle assembly removably fixed to said spinning beam; and a gasket between said spinning beam and said nozzle assembly; said nozzle assembly including a hollow generally cylindrical body having an internal step, a nozzle plate having a radially protruding portion resting on said step, a filter component resting on said nozzle plate, means cooperating with said cylindrical body for holding said filter component in place on said nozzle plate, said last-mentioned means having a central opening at a top portion thereof through which melt may pass downwardly to said filter component and having an outwardly and downwardly flaring internal surface coaxial with and adjacent to said central opening, and diametrically opposed radial projections from the outer surface of said cylindrical body at a lower end portion thereof; said spinning beam having a generally cylindrical receptacle portion for receiving said body, a horizontal wall at the upper end of said receptacle portion provided with a melt inlet opening in alignment with said central opening, and diametrically opposed inwardly projecting shoulders adjacent the lower end of said receptacle portion in position to cooperate with said radial projections from said cylindrical body to provide a bayonette lock for removably holding said nozzle assembly in said receptacle portion of said spinning beam.

6. Apparatus as claimed in claim 5, wherein said gasket has a central passage hole, is bell-shaped, and in its assembled condition has the edge portion thereof adjacent said central passage hole in contact with said horizontal wall at the upper end of said receptacle portion and the outer edge of the gasket in contact with a portion of the nozzle assembly.

7. Apparatus for melt spinning continuous filaments comprising a heating box including a plurality of upwardly extending bell-shaped receptacle portions with substantially vertical central axes, each of said receptacle portions having an upper wall provided with an axial melt inlet opening; a nozzle package positioned in each of said receptacle portions and having a nozzle plate at the lower end thereof; said heating box being provided with inwardly projecting shoulders on opposite sides of the lower end of each of said receptacle portions; and said nozzle packages each having outward projections positioned to contact said shoulders to axially lock said nozzle packages in said receptacle portions when, said packages are screwed into said receptacles.

8. Apparatus for melt spinning continuous filaments comprising a heating box including a plurality of upwardly extending bell-shaped receptacle portions with substantially vertical central axes, each of said receptacle portions having an upper wall provided with an axial melt inlet opening; a nozzle package positioned in each of said receptacle portions and having a nozzle plate at the lower end thereof; and nozzle gaskets positioned between the bottoms of the upper walls of said receptacle portions and the adjacent nozzle package in a manner so that melt flowing into the nozzle packages presses said gaskets against the bottoms of the upper walls of the receptacle portions and against inner edges of the nozzle packages while leaving open passages through which the melt may flow toward said nozzle plates.

* * * * *